US005109921A

United States Patent [19]

Aracena

[11] Patent Number: 5,109,921

[45] Date of Patent: May 5, 1992

[54] CONTROLLED WEAK POINT FOR WIRELINE CABLE

[75] Inventor: Luis Aracena, Maturin, Venezuela

[73] Assignee: Halliburton Company, Duncan, Okla.

[21] Appl. No.: 693,986

[22] Filed: Apr. 29, 1991

[51] Int. Cl.[5] ..... E21B 23/00

[52] U.S. Cl. ..... 166/65.1; 166/377; 166/385; 285/3

[58] Field of Search ..... 166/65.1, 385, 117, 166/377; 285/2, 3

[56] References Cited

U.S. PATENT DOCUMENTS 4,648,444 3/1987 Busch ..... 166/65.1
4,685,516 8/1987 Smith et al. ..... 166/65.1
4,697,641 10/1987 White ..... 166/65.1 X
4,706,744 11/1987 Smith et al. ..... 166/65.1
4,736,797 4/1988 Restarick, Jr. et al. ..... 166/65.1 X
4,753,291 6/1988 Smith et al. ..... 166/65.1
4,759,406 7/1988 Smith et al. ..... 166/65.1
4,776,393 10/1988 Forehand et al. ..... 166/377 X

*Primary Examiner*—Hoang C. Dang
*Attorney, Agent, or Firm*—C. Dean Domingue

[57] ABSTRACT

A controllable dual weak point device for insertion in a wireline between the cable and tool. The device consists of upper and lower sections that are slidably joined together in releasable interlocking manner with the upper section secured to the cable and the lower section secured to the tool. The upper and lower sections are joined together by a concentric arrangement of central tube, mandrel and limiting sleeve which are interconnected by first and second springs and first and second shear pin arrangements, i.e., the respective first and second weak points.

16 Claims, 6 Drawing Sheets

CONTROLLED WEAK POINT FOR WIRELINE CABLE

BACKGROUND OF THE INVENTION

1. Field of the Invention.

The invention relates generally to a protective cable coupling assembly for use with such as surface readout oil well tools and, more particularly, but not by way of limitation, it relates to an improved coupling structure that provides a controlled first weak point where the cable support will shear and a second weak point which will allow tool recovery.

2. Description of the Prior Art.

Applicant is unaware of any prior teachings that relate to a form of controlled weak point that allows surface readout oil well work to be performed with a greater degree of safety. Surface readout service has implicitly involved the necessity for working under pressure at the mouth of a well and, for this reason, it was necessary to use the thinnest possible cable. In those fields where combinations of depth, pressure and important production were found, the balance between diameter of cable and mechanical resistance to the needed stress was usually so precarious that the work could not, for all practical purposes, be performed with an acceptable margin of safety.

In prior practice, when a cable became hung within a well, its greatest stress was at the surface. Thus, if the testing tool could not be unhooked, it was necessary to stress the cable on the surface until some weak point allowed separation at the lower end of the cable. If the depth was great, the useful limit of the stress tension of the cable, less the weight of the vertical section of the cable (maximum pull-out), leave a very narrow margin for the construction of any "weak point". Keeping in mind that during operation the greater part of the capacity of the "weak point" is to carry the weight of the testing tool, which consists of the sinker bars plus the surface readout tool, and to open the sleeve of the E valve; we then find that the tolerance is so narrow that cutting can be effected through accidental maneuvers or even under the load produced by friction on the cable when flow velocity and production is high.

Due to the fact that the consequences of these types of accident were very costly, it was the practice of some operators to construct the clamp from the strongest cable, and when they could not unhook the surface readout tool, they were forced to cut the cable at the surface. Such failures discredited the surface readout operation in some oil fields to such a degree that revival of the practice now is extremely difficult.

SUMMARY OF THE INVENTION

The present invention operates such that once a first "weak point" is cut or separated, a backup prevents its liberation. Meanwhile, it remains electrically connected, sending signals and able to resist considerable stresses until such time as the operator slackens the force applied to the cable. At this moment, a second "weak point", whose resistance can be calculated so as to make it either the same as or different from the first, takes effect for continuing the tool unhooking and recovery operation, or to be cut if necessary. The controllable weak point apparatus is mounted within two tubular steel sections that are interconnected with one section firmly connected to the steel cable and a lower section connected to the surface readout tool. The upper and lower tubes are joined in such a way that they can be easily separated; however, an internal, tubular mechanism functions to not allow any separation until a predetermined force shears the pins of a weak point.

The internal mechanism consists of an inner tube carrying the cable therethrough and extending axially within a slotted mandrel which is disposed within a slotted limit sleeve which, in turn, is reciprocally received within upper and lower external sleeves. The inner tube is connected via shear pins to an upper crossover housing as an upper spring is compressed between the crossover housing and an adjusting nut threadedly received over the slotted mandrel. A support block secured within the lower external sleeve is secured by plural shear pins to the lower end of the slotted mandrel, and a lower spring is compressed between the lower end of the support block and an adjustable nut secured on the bottom of the inner tube. The upper and lower shear pin arrays provide the respective second and first weak points.

Therefore, it is an object of the present invention to provide a controllable weak point device for enabling wider use of surface readout tools.

It is also an object of the present invention to provide a connective device that provides greater safety in those wireline operations performed at greater depths.

It is still another object of the invention to provide a greater margin of safety in those wireline operations where depth and pressure render wireline work precarious.

Finally, it is an object of the present invention to enable the use of the thinnest possible cable while performing surface readout operations under pressure at the mouth of an oil well.

Other objects and advantages of the invention will be evident from the following detailed description when read in conjunction with the accompanying drawings which illustrate the invention.

DETAILED DESCRIPTION OF THE INVENTION

Figure 1A:
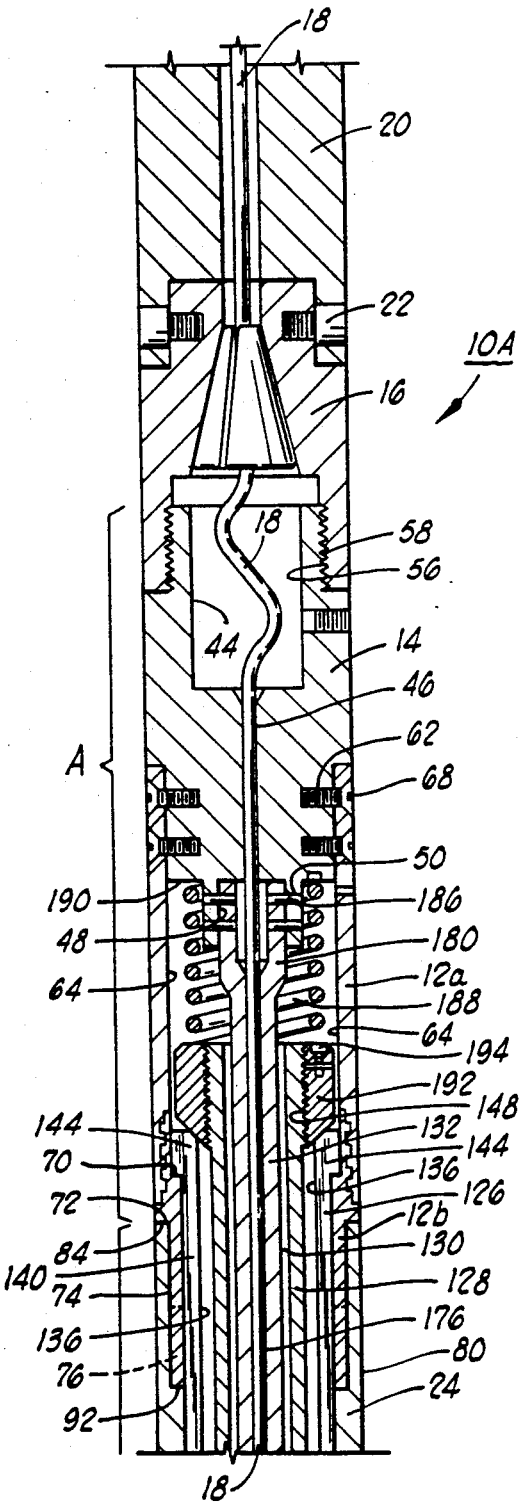
FIGS. 1A and 1B are upper and lower vertical sections of the weak point device as initially assembled.
Figure 1B:
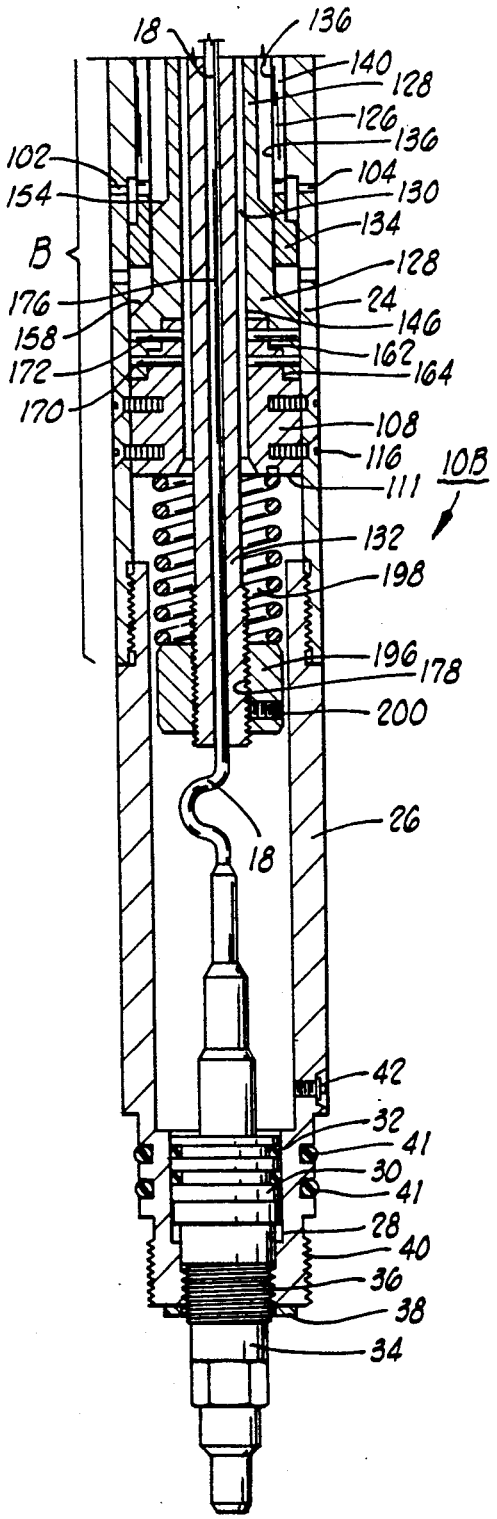

Referring to FIGS. 1A and 1B, the weak point device 10 consists primarily of the tubular structure contained within bracket A and bracket B. The A section includes upper external sleeve 12, i.e. upper part 12*a* and lower part 12*b*, which is secured to a crossover housing 14 affixed to a cone-type cable clamp assembly 16 receiving the downfall of cable 18. Cable 18 may be a lighter than usual wireline on the order of 3/16" or even 7/32". Side bars 20, as needed, may be affixed over cable assembly 16 by means of fasteners 22.

The lower or B section of device 10 is housed within a lower external sleeve 24 which is threadedly connected to a lower crossover housing 26. The crossover housing 26 includes a first axial bore 28 for receiving sealing flanges 30 and 0-rings 32 of a cable head 34 which is threadedly secured through threaded axial bore 36 and secured by lock nut 38. Cable head 34 may then be connected to the surface readout (SRO) tool in conventional manner as its housing is received over external threads 40 and sealing O-rings 41. A grease zerk 42 allows for filling the interior space of weak point device 10 with grease.

Figure 2:
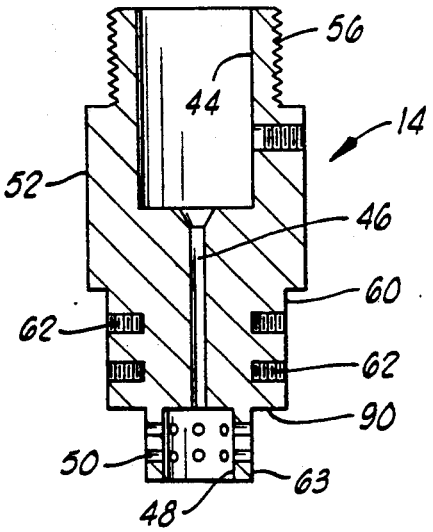
FIG. 2 is a view in vertical section of the upper crossover housing of the invention.

Referring also to FIG. 2, the upper crossover housing 14 is formed with a axial bore 44 for receiving cable flexure and this narrows into an axial bore 46 for carrying the down fall of cable 18. A bottom end axial bore 48 of intermediate diameter serves to receive an inner tube as will be further described. A plurality of dual rows of holes 50, in this particular case 8 holes in each row, serve to receive shear pins, as will be described. Externally, crossover housing 14 includes external surface 52 which is milled to receive threads 56 at the upper end for secure engagement within the threaded axial bore 58 of crossover housing 16. The external surface 52 is then reduced to a lesser diameter surface 60 which provides a seating surface for receiving the upper external sleeve

8 per row, 2. Thus, two rows of threaded holes 62, in this case are provided around surface 60. A collar surface 63 is then formed coaxial with axial bore 48.

Figure 3:
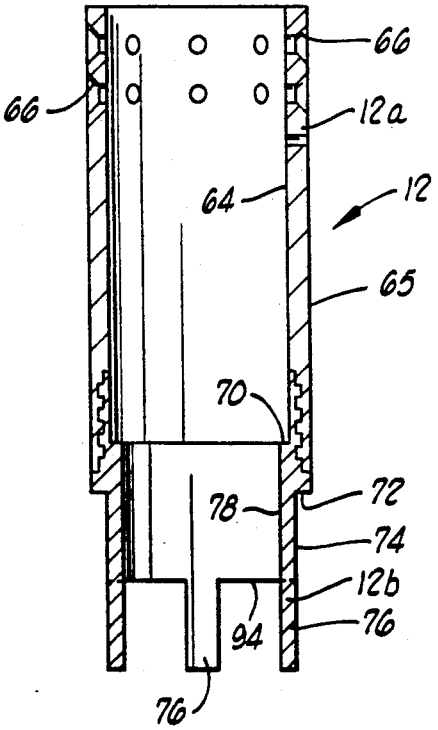
FIG. 3 is a view in vertical section of the upper external sleeve, a two part assembly, of the present invention.

Referring also to FIG. 3, the upper external sleeve 12 is formed from an upper part 12*a* and a lower part 12*b* that are threadedly connected. Parts 12*a* and 12*b* form an inner wall 64 and an external surface 65 is received over surface 60 of crossover housing 14. A plurality of screw holes 66 are aligned with the plurality of tapped holes 62 of housing 14 and secured by means of suitable bolts 68 (FIG. 1A). The external sleeve 12 is reduced in diameter at its lower end by means of internal shoulder 70 and external shoulder 72 to form a reduced diameter sleeve 74 which terminates in four parallel rectangular fingers 76. The fingers 76 are extensions of the reduced diameter sleeve surface 74 defining the same inside diameter 78.

Figure 4:
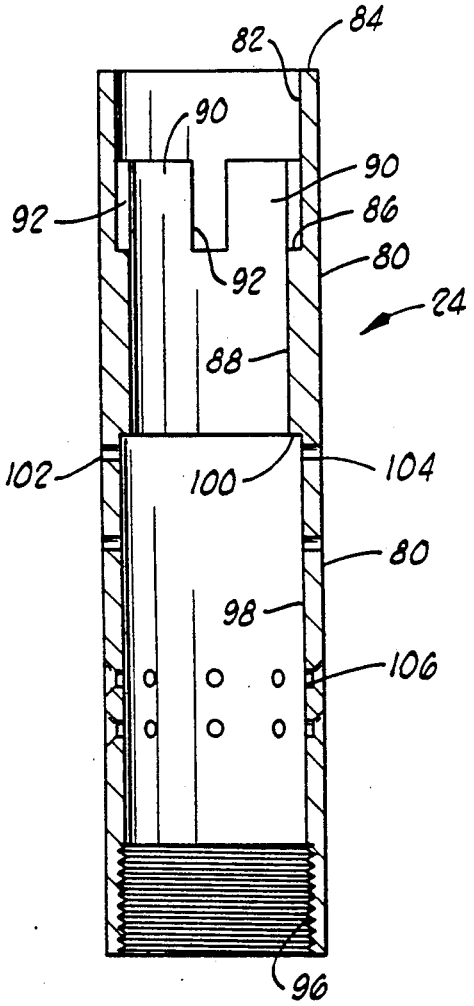
FIG. 4 is a view in vertical section of the lower external sleeve of the invention.

Referring also to FIG. 4, the lower external sleeve 24 is formed with a external surface 80 which is the same diameter as the external surface 65 of upper external sleeve 12. The upper end of external sleeve 24 has an internal bore 82 that extends from annular end 84 down to an inner annular shoulder 86 which terminates in an inner cylindrical wall 88. Formed integrally with inner wall 88 are four equi-spaced, arcuate lands 90 which define slots 92 between the respective lands 90. In joinder of the lower sleeve 24 to the upper sleeve 12, the interior surface 82 slides over the exterior surface 74 (FIG. 3) as rectangular fingers 76 slide down within the rectangular grooves 92 and, simultaneously, the rectangular lands 90 each interlock in a respective arcuate, rectangular slot 94 of external sleeve 12. The sliding relationship of this joint between upper and lower external sleeves 12 and 24 will be explained below in greater detail.

Figure 5:
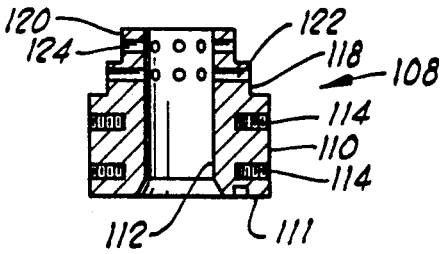
FIG. 5 is a view in vertical section of a support block which is secured within the lower external sleeve.

The lower end of external sleeve 24 includes internal threads 96 for receiving the lower crossover housing 26 therein and an internal bore defining inner wall 98 extends upward to a downward facing annular shoulder 100 adjacent inner wall 88. Small bores 102, 104 directed radially through inner wall 98 provide diametric aligning holes for assembly purposes. Two rows of circularly arrayed holes 106, e.g., 8 such holes in each row, receive screw fasteners for securing a support block 108 as shown in FIG. 5.

The support block 108 is formed with an outer cylindrical surface 110, a base 111 and an axial bore 112 as two circular rows of tapped screw holes 114 are formed for mating alignment with holes 106 (FIG. 4) as secured by a plurality of bolts 116. (FIG. 1B). The upper portion of support block 108 is formed with a stepped mounting arrangement wherein a first shoulder forms a cylindrical surface 118 and a second upwardly facing shoulder forms a further reduced diameter cylindrical surface 120. The cylindrical surfaces 118 and 120 each include a plurality of radially aligned shear pin holes 122 and 124, respectively. In present design, 8 such pin holes are provided around the circumfery.

Figure 6:
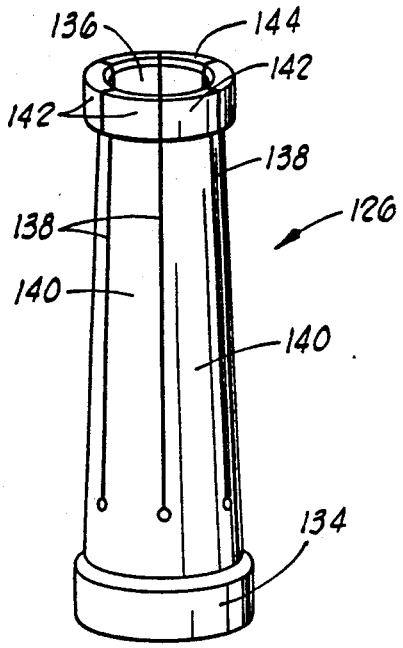
FIG. 6 is a perspective view of a limit sleeve in fingers-closed position as employed in the present device.

Referring again to FIGS. 1A and IB, the internal workings of the weak point device 10 also include a limit sleeve 126 of the finger type which, in effect, constitutes a variable diameter tube. See FIG. 6. Reciprocally disposed within limit sleeve 126 is a slotted mandrel 128 that has an axial bore 130 for receiving a central tube 132. See also FIG. 7. The limit sleeve 126 (FIG. 6) has a bottom collar 134 (bottom as installed as shown in FIG. 1A and 1B) and a central bore 136. A plurality of longitudinal slots 138 divide the limit sleeve 126 into a plurality of six fingers 140 which are formed with collar portions 142 about what is the installed upper end collar 144.

Figure 7:
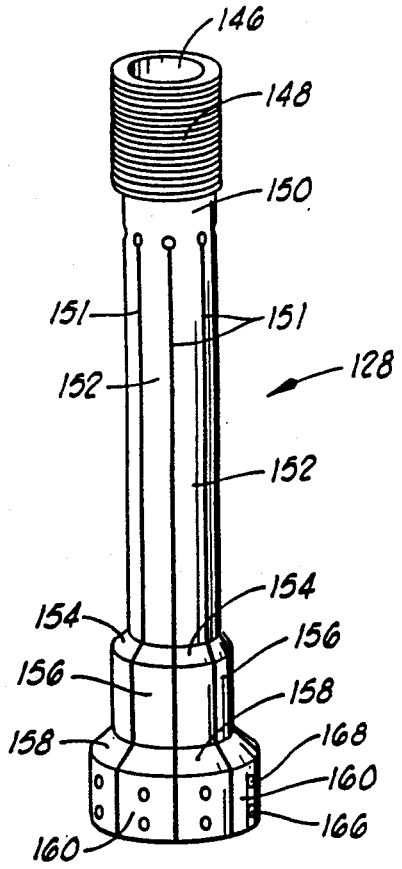
FIG. 7 is a perspective view of a slotted mandrel in fingers-open position as used in the present device.

Next, and referring to FIG. 7, positioned within bore 136 of limit sleeve 126 is the slotted mandrel 128. Mandrel 128 includes a central bore 146 and upper end threads 148 as the lower portion of a cylinder 150 is slit into equi-sized longitudinally extending fingers 152. Fingers 152 are each formed with a first canted annular shoulder 154 which extends into a cylindrical surface 156, and a second canted annular shoulder 158 which extends to an outer diameter circumferal surface 160. As shown in FIG. 1B, the lower end of mandrel central bore 146 is formed with successive counterbores 162 and 164 which are received down over the stepped cylindrical surfaces 120 and 122 (FIG. 5) of support block 108. As shown in FIG. 7, a circular array of holes 166 and 168 are formed to align with respective pin holes 122 and 124 (FIG. 5) in order to receive a plurality of shear pins 170 and 172 therethrough.

Figure 8:
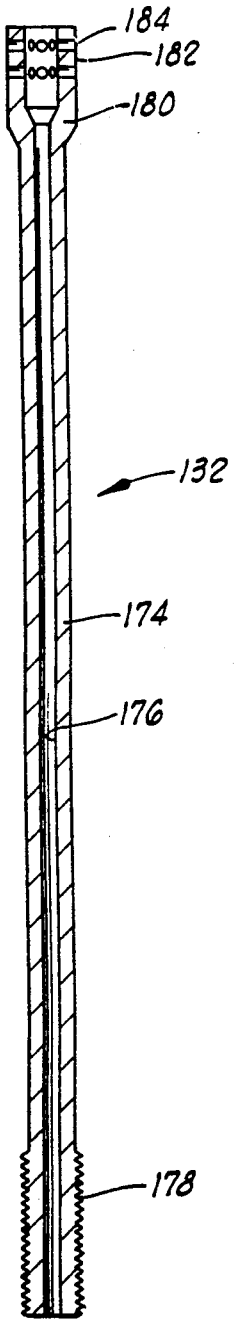
FIG. 8 is a view in vertical section of an inner tube of the present device.

The center or inner tube 132 is then received through the central bore 146 of the slotted mandrel 128. As shown in FIG. 8, inner tube 132 is formed as an elongated tube 174 having a central bore 176 for receiving the wire cable 18 downward therethrough. Inner tube 132 is relatively fragile and is pre-calculated to withstand 1000 pounds of force. The lower end of tube 174 has external threads 178 and the upper end of tube 174 is formed with a receiving cup 180 having enlarged diameter sidewall 182 and including two rows of circularly arrayed pin holes 184 therearound. In this case, there are 8 such radial pin holes 184 in each row and the cup 180 is adapted for insertion within the bore 48 of crossover housing 14 (see FIG. 1A) and alignment of shear pin holes 122, 124 with pin holes 50, then to be secured by means of a plurality of shear pins 186 (see FIG. 1A).

An upper spring 188 is compressed between a downwardly facing shoulder 190 of crossover housing 14 and an upper adjustment nut 192 which is threadedly secured about threads 148 of mandrel 128. A locking screw 194 secures adjustable nut 192 in a pre-set position as will be further described. A lower nut 196 (FIG. 1B) is secured on threads 178 of inner tube 132 (FIG. 8) to support a lower spring 198 in compression beneath the base 111 of support block 108. After initial adjustment, a set screw 200 can be tightened to maintain nut 196 in a locked position.

The weak point device 10 must first be properly assembled and adjusted in order to function properly. Thus, the upper external sleeve 12 is inserted into the lower external sleeve 24, making sure that the anti-rotation pins 76 are securely seated in the slots 92. The limit sleeve 126 is then inserted down into the end of external sleeve 24 with slotted end collar 144 first. Then, opening the eight slots 151 of the mandrel 128 by hand, the mandrel 128 is inserted down within the limit sleeve 126 until connection is accommodated with the lower end of mandrel 128 secured over the support block 108 in secure alignment over the stepped faces 118 and 120. The pin holes 166 and 168 of mandrel 128 are then aligned with pin holes 122 and 124, respectively, of support block 108 and pins 170 and 172 are inserted in each of the holes of the respective circular array. The circular array of tapped holes 114 of support block 108 are then aligned with the holes 106 in lower external sleeve 24, and a plurality of fasteners 116 are secured therein using a suitable cement, e.g., LOCTITE TM.

A 3.0 mm metal bar is then placed through orifice 102, 104 (FIG. 1B) in order to prevent the limit sleeve 126 from backing up, and the nut 192 is threaded onto the end of threads 148 of mandrel 128 within the external sleeve 12. The nut 192 is adjusted while the diameter of the upper collar 144 of limit sleeve 126 widens, and until collar 144 is in secure contact with the inner wall 64 of upper external sleeve 12. The 3 mm bar may then be removed.

The upper cup end 180 of inner tube 132 may then be introduced into the axial bore 48 of crossover housing 14 and, after matching up pin holes 50, the requisite number of shear pins 186 may be inserted. The spring 188, a 40 pound No. 4 spring, is then placed adjacent the base of crossover housing 14, and the threaded end 178 of central tube 132 is placed axially within the central bore 130 of mandrel 128. The spring 198, e.g., a 60-pound spring, is then placed over the lower end of central rod 132 adjacent the base 111 of support block 108 and the adjusting nut 196 is turned onto threads 178. Then, holding down the crossover housing 14 by hand until the latter begins to travel on its own within the upper external sleeve 12, the crossover housing 14 is turned clockwise by hand while holding the external sleeve 12 in the other hand and until a firm torsion is felt. This is a sign that both ends of the upper spring 188 have become seated in their respective anti-rotation slots thereby to prevent the nut 192 from becoming loosened. Then continue tightening the lower nut 196 until the crossover housing 14 becomes completely inserted down within upper external sleeve 12. At this point, the lower nut 196 must be turned six additional turns more with tightening of the set screw 200 to lock the nut position. The screw holes 62 in crossover housing 14 may be lined up by turning clockwise whereupon the bolts 68 are inserted in tight bond to secure the assembly.

The cone-type or other cable clamp assembly 16 may then be assembled while leaving about 2 feet of the electrical conductor cable 18. This slack section of cable 18 may then be run down through axial bore 46 of crossover 14 and on down through central bore 176 of central tube 132. The lower end of cable 18 can then be spliced into the cable head assembly 34 using standard procedures. Finally, the crossover housing 26 can be threaded into the lower external housing 24 and DC-type grease compound can be pumped through zerk 42 until grease emits from all orifices.

In operation, the device is first assembled and adjusted step-wise in the manner previously discussed and in the form shown in FIGS. 1A and 1B. The device 10 is then ready for service as a "weak point" as it is interconnected between a downhole wireline or cable 18 and the associated SRO tool.

When the device 10 or cable 18 gets hung up within a well, its greatest stress will be at the surface. If the testing tool cannot be unhooked, it is necessary to stress the cable at the surface until a "weak point" separates on the lower end of the cable. At greater depths, the useful limit of the stress tension of the cable, less the weight of the vertical section of the cable, i.e., maximum pull-out stress, combine to leave a very narrow margin for the construction of a "weak point".

If it is kept in mind that during operation the greater part of the capacity of the weak point is used to carry the weight of the testing tool, consisting of sinker bars and the SRO, you may then be operating so near the cutting tension that cutting may take place accidentally or even under load produced by friction o the cable in high velocity production flow situations. With weak point device 10, once the weak point is cut, a backup prevents its liberation and it remains electrically connected, sending electrical signals and is still able to resist great stresses, until such time as the operator slackens the tension applied to the cable. At this time, a second or backup weak point is available for continuing with the SRO unhooking and recovering operation, or to be cut if finally necessary. The resistance of the second weak point can be calculated so that it is a specific value more or less of the first weak point breakage point.

In normal operation, the device 10 is in the attitude of FIGS. 1A and 1B wherein the cable 18 tension will be transmitted to the slotted mandrel 128 and also to the pins 170 and 172 at the first weak point, i.e., the lower set of pins in the support block 108. The external sleeve 12 has a shoulder 70 upon which rests the uppermost collar 144 of the finger-type limit sleeve 126. The limit sleeve 126, in turn, rests against the adjustable nut 192 that has been threaded onto threads 148 of mandrel 128 (FIG. 7). The conical surface of nut 192 keeps the limit sleeve collar 144 spread open thereby to adjust its seating firmly against the shoulder 70 of external sleeve 12.

Figure 9A:
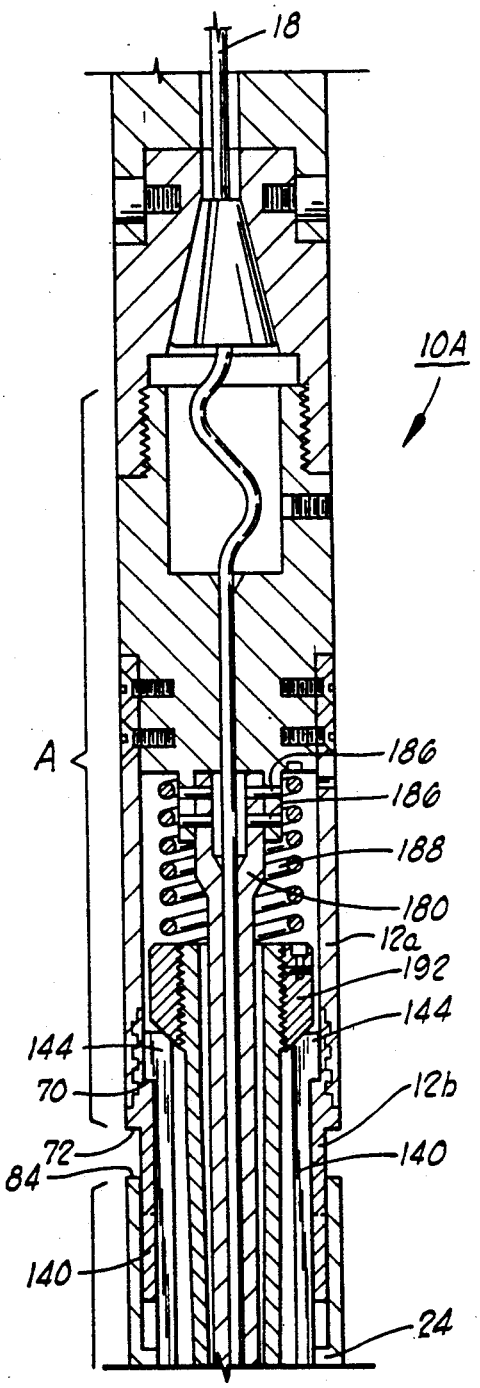
FIGS. 9A and 9B are upper and lower vertical sections of the weak point device in a first stage of actuation.
Figure 9B:
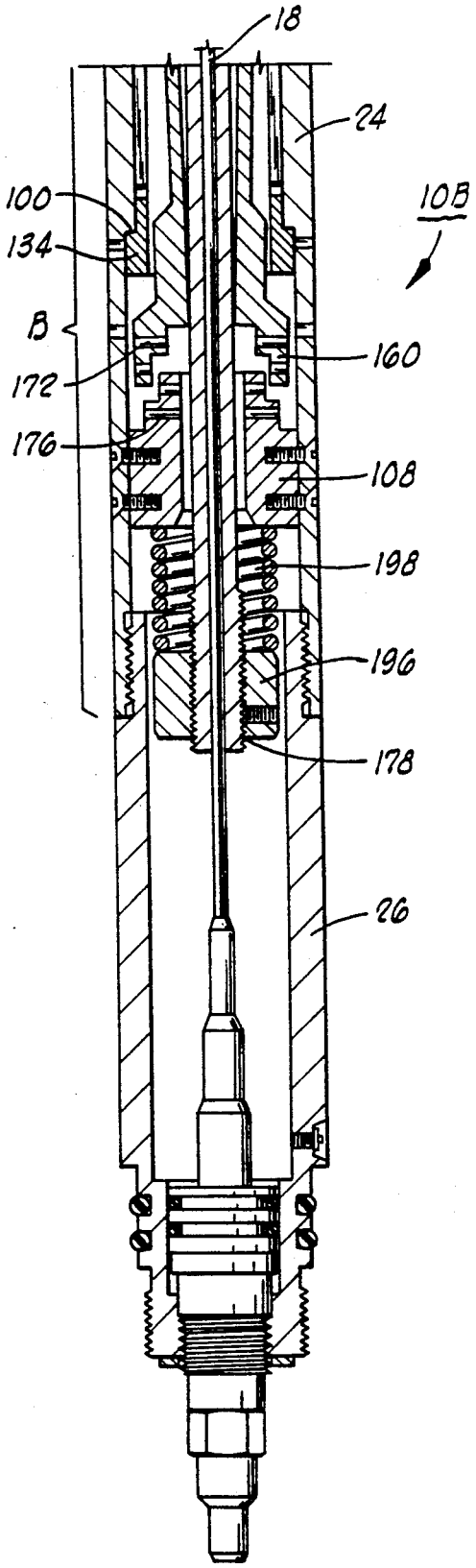

Whenever the force on cable 18 exceeds the shear strength of the lower pins 170, 172, the pins will be sheared to allow both external sleeves 12 and 24 to separate. This attitude is shown in FIGS. 9A and 9B.

The separation comes between downwardly facing shoulder 72 of external sleeve 12 and the upper annular rim 84 of external sleeve 24, and the limit sleeve 140 will limit the separation to about 10 mm (0.30 inches) because the lower end collar 134 of limit sleeve 140 will shoulder up against the downwardly facing shoulder 100 of external sleeve 24. This limited movement is enough for the finger-type lower end of mandrel 128 (when pins are sheared) to collapse and thus decrease the diameter of fingers 160. In this position, i.e., as in FIG. 9A and 9B with pins 171 and 172 sheared, the system will continue to operate as device 10 supports the required operating tension of cable 18. Note that lower external housing 24 and lower crossover 26 have moved downward to compress the lower spring 198.

Figure 10A:
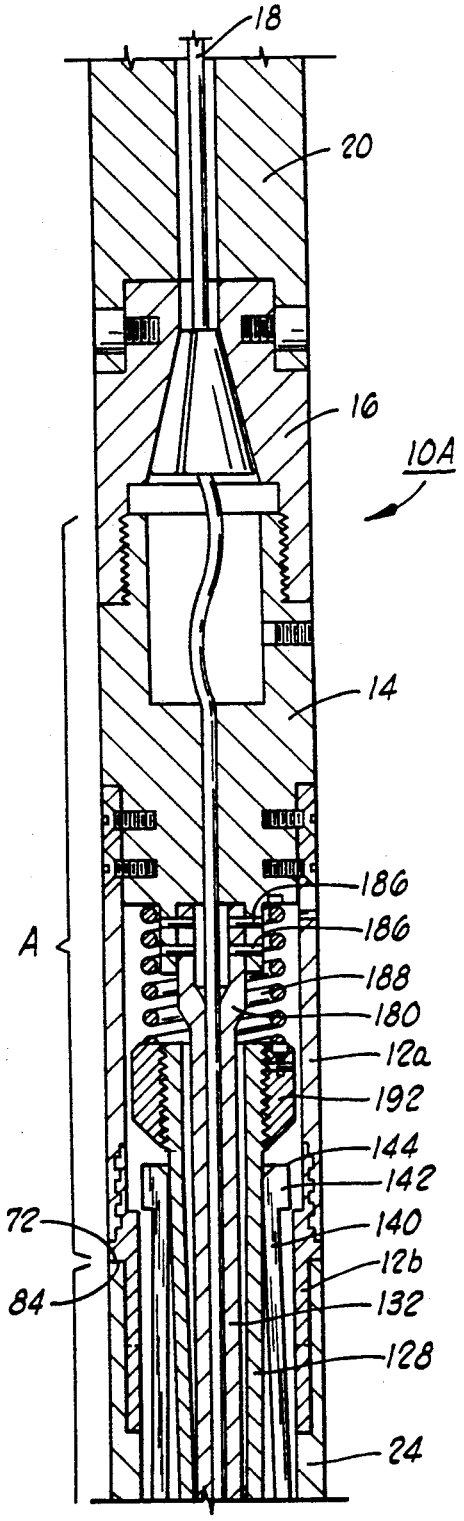
FIGS. 10A and 10B are upper and lower vertical cross sections of the weak point device in a second stage of operation.
Figure 10B:
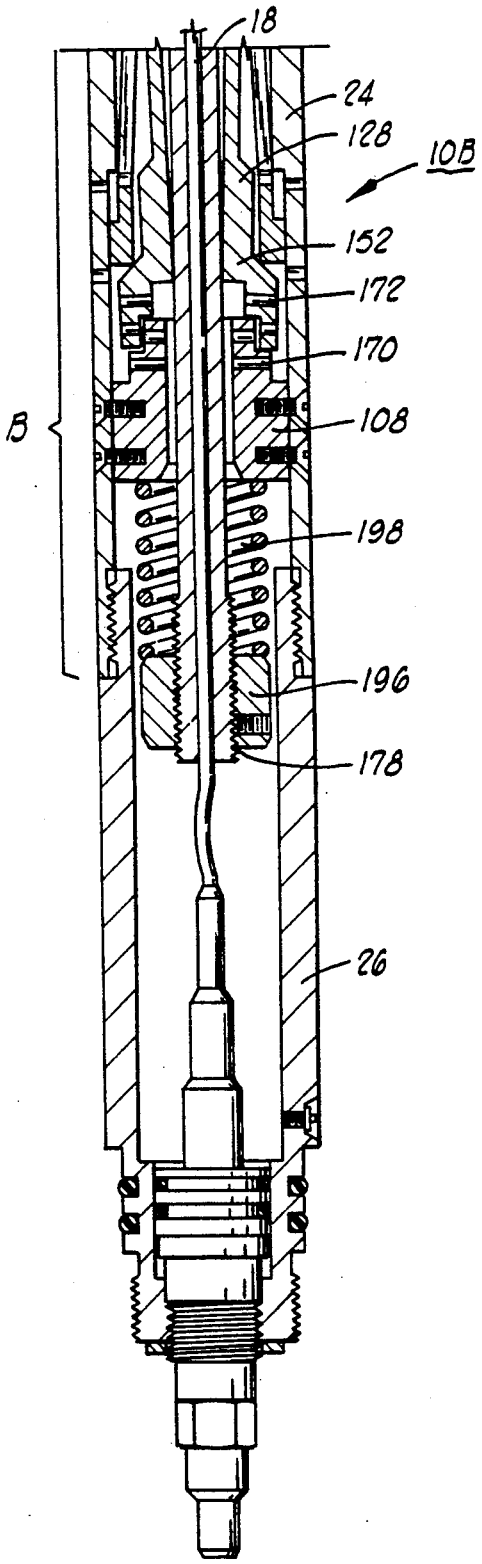

Referring now to FIGS. 10A and 10B, if the cable tension is removed from cable 18, the spring force of lower spring 198 (approximately 100 lbs.) will retract the upper external sleeve 12 against the lower external sleeve 24, i.e., a downward movement, thus again closing the gap between downwardly facing shoulder 72 and upper rim 84 of respective external sleeves 12 and 24. Since the finger-type mandrel 128 cannot return to its original position because the fingers 152 have collapsed, the upper spring 188 (approximately 50 lbs. force) will compress thus retracting the nut 192 (an upward movement) to allow the upper collar 144 of the limit sleeve 140 to collapse inward, thus decreasing the diameter across collar 144. When this occurs, any tension applied to cable 18 will be transmitted directly to the second weak point, i.e., upper pins 186.

Figure 11A:
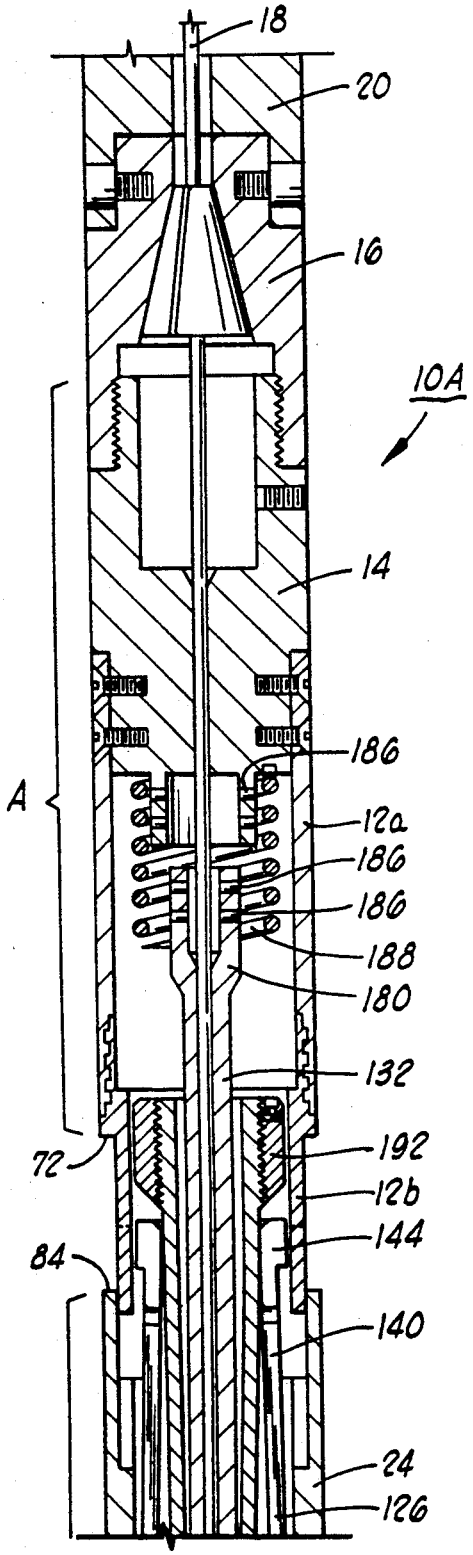
FIGS. 11A and 11B are upper and lower vertical cross sections of the weak point device in a third stage of operation.
Figure 11B:
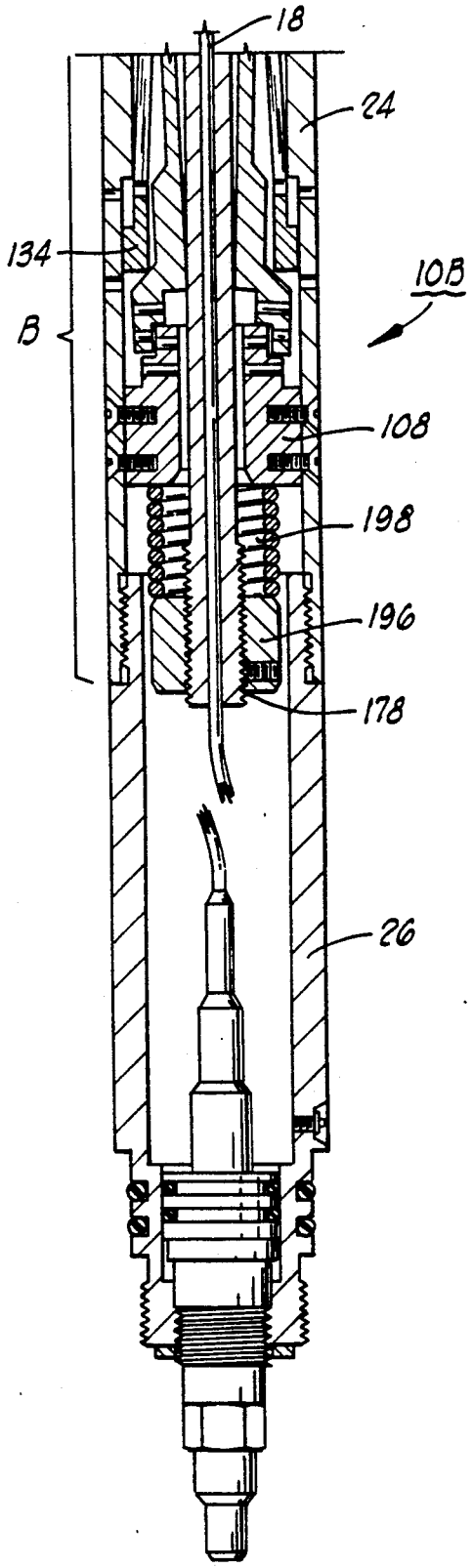

As shown in FIGS. 11A and 11B, this force shears the upper pins 186 whereupon the entire B assembly, i.e., inner tube 132, mandrel 128, limiting sleeve 126, lower external sleeve 24 and lower crossover 26 and attached test equipment will fall away breaking the electric cable 18 (FIG. 11B). This will then allow the advantage of permitting recover of the sinker bars 20 along with the entire cable 18 while also preventing the downhole pressure from throwing the gear violently from the well.

The foregoing discloses a novel controllable weak point tool which can be inserted between a downhole wireline and an SRO tool or the like to better manage the wireline operation while also contributing to a considerably safer operation. The shear pins should be of phosphorated bronze material calculated to support a given number of pounds each, and the upper and lower springs may be varied in compression value so long as complementary adjustment is made. In essence, the tool provides first and second weak points wherein a first weak point can fail while still allowing continuation and completion of a test as well as additional tensions exerted in recovery of the downhole SRO tool; and at some selected time the tension can be relieved so that the second weak point will shear to sever the cable and release a bottom portion of the connective tool for recovery of the wireline cable, sidebars and the like.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A controllable break device for use in interconnection with wireline cable and cable head comprising:

an upper sleeve section that is secured to said cable while leading a length of cable axially therethrough;

a lower sleeve section slidingly engaged with a portion of said upper sleeve section and receiving the length of cable axially therethrough for being secured to the cable head;

an inner tube having upper and lower ends extending axially within said upper and lower sleeve sections, said inner tube carrying the cable therethrough;

mandrel means receiving the inner tube therethrough and having upper and lower ends extending between said upper and lower sleeve sections; first shear pin means securing the mandrel means lower end to the lower sleeve section;

second shear pin means securing the inner tube upper end to said upper sleeve section; and limit sleeve means disposed coaxial to said mandrel means and extending between the upper and lower sleeve sections, said limit sleeve means coacting selectively with said mandrel means to allow parting of said first shear pin means upon a predetermined amount of cable tension, and subsequent parting of said second shear pin means upon release of cable tension to allow separation of the upper and lower sleeve sections.

2. A break device as set forth in claim 1 wherein said mandrel means comprises:

an upper neck threadedly receiving an adjustment nut thereon;

a plurality of longitudinal, radially spreadable fingers extending from the upper neck through the lower end, said radially spreadable fingers each defining a seating surface with at least one radially oriented shear pin holes; and a support block secured within said lower sleeve section and presenting a revolutional seating surface for receiving said spreadable fingers in mating engagement, said seating surface having mating shear pin holes.

3. A break device as set forth in claim 2 which is further characterized to include:

first spring means compressed between the lower end of said mandrel means and the inner tube lower end; and second spring means compressed between the mandrel means upper end and the upper sleeve section.

4. A break device as set forth in claim 1 wherein said limit sleeve means comprises:

a cylindrical tube having an upper portion and a lower radially extending collar normally seated around said mandrel means and against said lower sleeve section;

plural longitudinally extending slits dividing the upper portion into a circular array of spreadable fingers having upper ends; and plural radial collar segments formed on each of the finger upper ends for spreadable contact with said upper sleeve section.

5. A break device as set forth in claim 4 wherein said mandrel means comprises:

an upper neck threadedly receiving an adjustment nut thereon;

a plurality of longitudinal, radially spreadable fingers extending from the upper neck through the lower end, said radially spreadable fingers each defining a seating surface with at least one radially oriented shear pin holes; and a support block secured within said lower sleeve section and presenting a revolutional seating surface for receiving said spreadable fingers in mating engagement, said seating surface having mating shear pin holes.

6. A break device as set forth in claim 5 which is further characterized to include:

first spring means compressed between the lower end of said mandrel means and the inner tube lower end; and second spring means compressed between the mandrel means upper end and the upper sleeve section.

7. A break device as set forth in claim 4 which is further characterized to include:

an inwardly extending annular shoulder within said upper sleeve section for coaction with said plural radial collar segments to limit by a predetermined amount the withdrawal of the lower sleeve section from the upper sleeve section upon parting of said first shear pin means.

8. A break device as set forth in claim 6 which is further characterized to include:

an inwardly extending annular shoulder within said upper sleeve section for coaction with said plural radial collar segments to limit by a predetermined amount the withdrawal of the lower sleeve section from the upper sleeve section upon parting of said first shear pin means.

9. A break point device as set forth in claim 1 which is further characterized to include:

a crossover section secured to said upper sleeve section; and a cable clamp assembly and side bars secured to said crossover.

10. A break device as set forth in claim 9 which is further characterized to include:

a crossover section secured to said lower sleeve section and including means for rigidly seating said cable head.

11. A device for interconnection between a wireline cable and cable head to effect dual weak point control, comprising:

first sleeve means having a first end secured to said cable and having a second end;

second sleeve means having a first end receiving the first sleeve means second end in slidable insertion and having a second end secured to said cable head;

an inner tube carrying the cable therethrough and disposed to extend from the first sleeve means through the second sleeve means;

a mandrel means including first shear pin means secured to said second sleeve means and disposed coaxially over said inner tube;

first spring means compressed between said inner tube and said second sleeve means;

second shear pin means securing said inner tube axially within said first sleeve means;

second spring means compressed between said mandrel means and said first sleeve means first end;

limit sleeve means disposed co-axially over said mandrel means within said first and second sleeve means;

whereby greater than a pre-set cable tension will shear the first shear pin means to release the mandrel means and limit sleeve means for limited upward movement which allows the second sleeve means to drop a limited amount relative to said first sleeve means while said cable tension continues being applied, and removal of cable tension causes parting of the cable and complete separation of the first and second sleeve means.

12. A device as set forth in claim 11 wherein said limit sleeve means comprises:

a first end having a continuous, radially extending outward collar;

plural circularly arrayed longitudinal fingers extending from adjacent s id collar to their respective ends; and an outward, radially extending, arcuate collar segment formed on each of the plural finger ends.

13. A device as set forth in claim 12 which is further characterized to include:

an upward facing annular shoulder formed around the inside of the first sleeve means second end for coaction with the arcuate collar segments on said plural finger ends; and a downward facing annular shoulder formed around the inside of the second sleeve means at generally a mid-point for coaction with said limit sleeve means first end outward collar.

14. A device as set forth in claim 11 wherein said mandrel means comprises:

a mandrel having an axial bore with first threaded end and extending a plurality of spreadable fingers each terminating in an annular shoulder; and a support block having a base and side wall which is secured within the second sleeve means, and a conical stepped formation for receiving abutment of the spreadable finger annular shoulders;

wherein a plurality of first shear pins are connected to secure each respective annular shoulder.

15. A device as set forth in claim 12 wherein said mandrel means comprises:

a mandrel having an axial bore with first threaded end and extending a plurality of spreadable fingers each terminating in a annular shoulder; and a support block having a base and side wall which is secured within the second sleeve means, and a conical stepped formation for receiving abutment of the spreadable finger annular shoulders;

wherein a plurality of first shear pins are connected to secure each respective annular shoulder.

16. A device as set forth in claim 15 which is further characterized to include:

an upward facing annular shoulder formed around the inside of the first sleeve means second end for coaction with the arcuate collar segments on said plural finger ends; and a downward facing annular shoulder formed around the inside of the second sleeve means at generally a mid-point for coaction with said limit sleeve means first end outward collar.

* * * * *